US007473027B2

(12) United States Patent
Goeller

(10) Patent No.: US 7,473,027 B2
(45) Date of Patent: Jan. 6, 2009

(54) WATCH WHOSE MOVEMENT INCLUDES A CONSTANT FORCE DEVICE

(75) Inventor: Eric Goeller, Les Hôpitaux Vieux (FR)

(73) Assignee: Montres Breguet SA, L'Abbaye (CH)

( * ) Notice: Subject to any disclaimer, the term of this patent is extended or adjusted under 35 U.S.C. 154(b) by 0 days.

(21) Appl. No.: 11/548,261

(22) Filed: Oct. 10, 2006

(65) Prior Publication Data

US 2007/0127319 A1 Jun. 7, 2007

(30) Foreign Application Priority Data

Oct. 10, 2005 (EP) ..... 05022045

(51) Int. Cl.
*G04B 15/00* (2006.01)

(52) U.S. Cl. ..... 368/124; 368/220

(58) Field of Classification Search ..... 368/124–125, 368/126–128, 168–169, 220
See application file for complete search history.

(56) References Cited

U.S. PATENT DOCUMENTS

| | | | | |
|---|---|---|---|---|
| 6,863,434 | B2 * | 3/2005 | Mojon | 368/127 |
| 6,997,602 | B2 * | 2/2006 | Mojon et al. | 368/127 |
| 2007/0147179 | A1 * | 6/2007 | Girardin et al. | 368/147 |

FOREIGN PATENT DOCUMENTS

| | | | |
|---|---|---|---|
| CH | 47297 | 6/1909 | |
| CH | 98828 | 5/1923 | |
| CH | 120028 | 7/1927 | |
| DE | 818 024 | 10/1951 | |
| EP | 1 319 997 | A1 | 6/2003 |
| EP | 1 528 443 | A1 | 5/2005 |

OTHER PUBLICATIONS

European Search Report issued in corresponding application No. EP 05 02 2045, completed Jul. 21, 2006.

* cited by examiner

*Primary Examiner*—Felix O Figueroa
*Assistant Examiner*—Sean Kayes
(74) *Attorney, Agent, or Firm*—Griffin & Szipl, P.C.

(57) ABSTRACT

The movement (1) of the watch includes a constant force device (14) inserted in a going rain connecting a spring barrel (2) to an escapement having an escapement wheel and including a third wheel which completes one revolution in several minutes. The input element of the constant force device (14) is the third wheel (12), the output element of said device (14) being a second third wheel (20) connected via gearing to the seconds pinion (38). The second third wheel is secured to a star wheel (26) that only releases the train upstream of the constant force device once per minute, thus forming an independent minutes display because the minute hand (7) jumps forward at each minute. This arrangement minimizes the transmission of shocks between the constant force device and the escapement and can advantageously be combined with a tourbillon (40).

8 Claims, 2 Drawing Sheets

WATCH WHOSE MOVEMENT INCLUDES A CONSTANT FORCE DEVICE

This application claims priority from European Patent Application No. 05022045.8 filed 10 Oct. 2005, the entire disclosure of which is incorporated herein by reference.

BACKGROUND OF THE INVENTION

The present invention concerns a watch with a mechanical movement whose escapement is driven via a constant force device.

In mechanical horology, the expression "constant force device" has been used for more than a century to designate a member inserted in the gear train connecting the main spring to the escapement and comprising a permanently loaded intermediate spring, in order to transmit a relatively constant torque to the escapement, corresponding to the tension of the intermediate spring. This tension oscillates a little, but within a small margin and its mean value remains constant over time. Thus, variations in the state of winding of the main spring do not make the forces applied to the mechanical oscillate vary, thus the amplitude and frequency of the mechanical oscillator are more stable.

The constant force device temporarily locks the part of the gear train located upstream, and then periodically releases it, which tightens the intermediate spring. In generally, the release rate is once per second and this allows a seconds indicator hand, commonly called the independent seconds, to jump forward at this rate. Constant force devices are thus almost always combined with the seconds wheel, with an independent seconds display. Various examples of such combinations and the operation thereof are disclosed in Patent publication nos. CH 47 297, CH 98 828, CH 120 028, EP 1 319 997 and EP 1 528 443. The last cited publication further provides that the regulator member driven by the constant force device could be a tourbillon, which is secured to the output wheel of the constant force device.

The stop and periodic release mechanism of the independent seconds device must be controlled from the wheel that follows the seconds wheel, thus the escapement wheel. The first member to be released is generally called the "flirt", because at the moment that it is released, it rotates very quickly to complete one revolution or a fraction of a revolution, until it is locked again. The element that locks the flirt is generally a star wheel with N branches, completing one revolution in N seconds in order to release the flirt once per second. Typically, as shown by CH Patent No 47 297, this star wheel is secured to the escapement wheel, since the latter rotates at a speed (one revolution in six seconds) which corresponds to an acceptable number of branches of the star wheel. The instantaneous rotation and consecutive abrupt stop are accompanied by the entire gear train located upstream and by the display members connected thereto. The inertia of these elements means that the stop mechanism transmits non-negligible shocks to the escapement via the star wheel. A substantial part of the advantages due to a constant force driving the escapement is therefore lost.

SUMMARY OF THE INVENTION

It is an object of the present invention to overcome the aforementioned drawbacks of the prior art, by providing a watch movement with a constant force device whose instantaneous movements disrupt as little as possible the operating conditions of the escapement and the mechanical oscillator. It is an additional object to be able to drive a tourbillon in good conditions with such a constant force device.

Thus, the invention concerns a watch whose movement comprises a constant force device inserted in a going train connecting a barrel spring to an escapement, this gear train including a third wheel which completes one revolution in several minutes and drives a seconds pinion completing one revolution per minute, the constant force device including an input element, an output element coaxial to the input element and mechanically connected to a star wheel with several branches, a spiral spring resiliently connecting the input element to the output element in rotation, and a stop train meshed with the input element and provided with a stop wheel having at least one finger arranged to abut against one branch of said star wheel, the watch being characterized in that the input element of the constant force device is the third wheel, the output element of said device being a second third wheel connected by gearing to the seconds pinion.

Thus, the shocks caused by the flirt formed by the finger of the stop train, when it abuts against the star wheel, barely reverberate at all in the escapement, since there exists a high multiplication ratio gearing between the output element of the constant force device and the escapement wheel, with an intermediate wheel set which is the seconds wheel set. The escapement thus receives a motor torque that is as constant as possible.

According to a preferred embodiment of the invention, the watch includes a so-called independent minutes display, by a minute hand driven by the going train, the number of branches of the star wheel being equal to the number of minutes during which the star wheel completes one revolution, such that the rotation of the star wheel releases the stop train, the third wheel set and the minute hand once per minute. The fact that the minute hand thus jumps from one division to the next on the scale of minutes on the watch dial provides an original visual effect and facilitates reading of the time.

It should also be noted that if the watch includes a tourbillon mechanism the arrangement of the invention of the device on the minute easily allows it to be disposed outside the tourbillon mechanism.

BRIEF DESCRIPTION OF THE DRAWINGS

Other features and advantages of the present invention will appear from the following description, which presents an advantageous embodiment by way of non-limiting example with reference to the annexed drawings, in which.

DETAILED DESCRIPTION OF ONE EMBODIMENT

Figure 1:
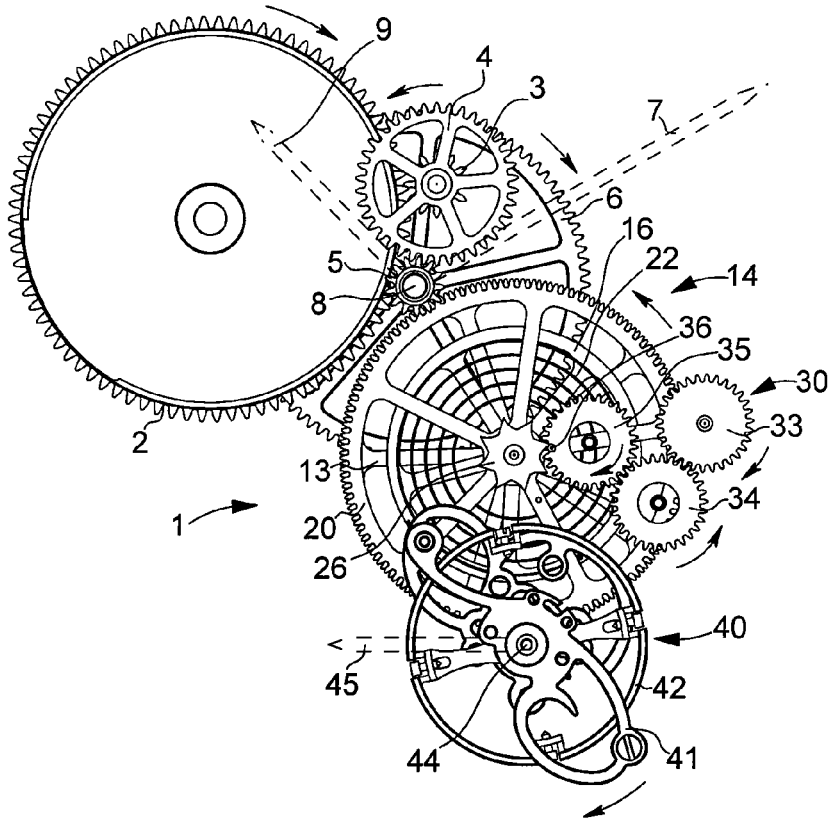
FIG. 1 shows a top view of the main elements of a watch movement provided with a tourbillon and a constant force device according to the invention, with a schematic diagram of the hands displaying the time.
Figure 2:
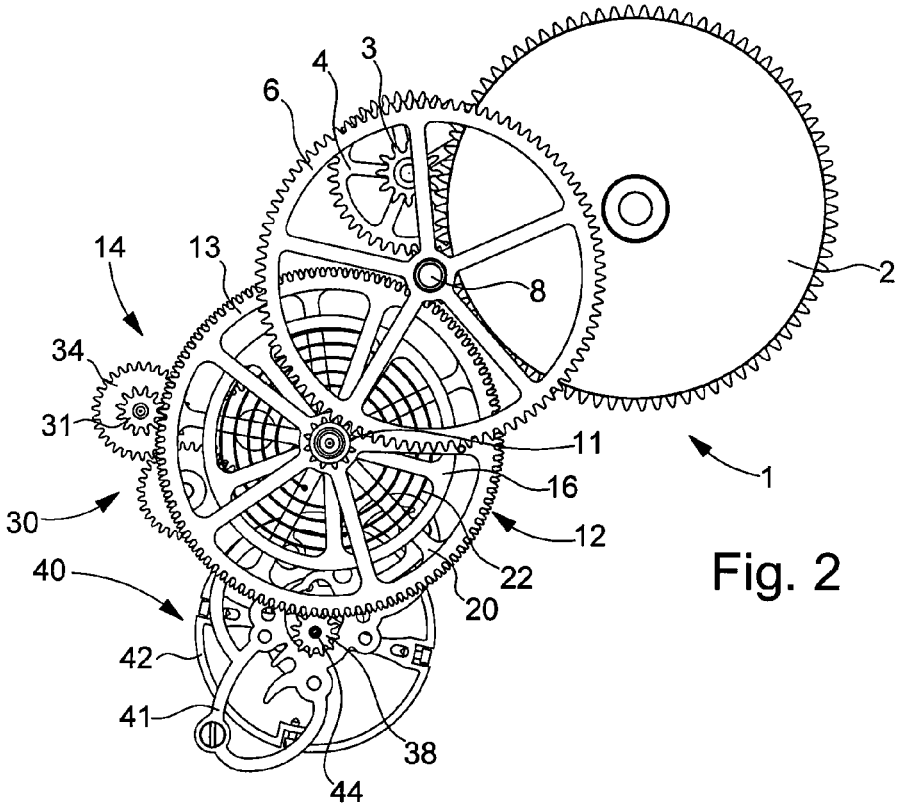
FIG. 2 is a bottom view of the movement shown in FIG. 1.

In the movement of watch 1 shown in a simplified manner in FIGS. 1 and 2, a spring barrel 2 drives in rotation the pinion 3 of an intermediate wheel 4, called the eight day wheel, which meshes with the centre pinion 5 of a centre wheel 6 completing one revolution per hour. The presence of intermediate wheel 4 in this example is not directly connected to the invention; it is due to the fact that movement 1 comprises several complications that are not shown and that have to be driven by barrel 2, which is provided with a longer spring and which rotates more quickly than ordinary barrels. The spring barrel can be wound manually or automatically. As in a conventional movement, a cannon-pinion carrying the minute hand 7 is friction mounted on arbour 8 of centre wheel 6 and rotatably carries an hour wheel carrying an hour hand 9. For the sake of clarity, only the hands of the time display device are shown in the drawings, in a very schematic manner.

Figure 3:
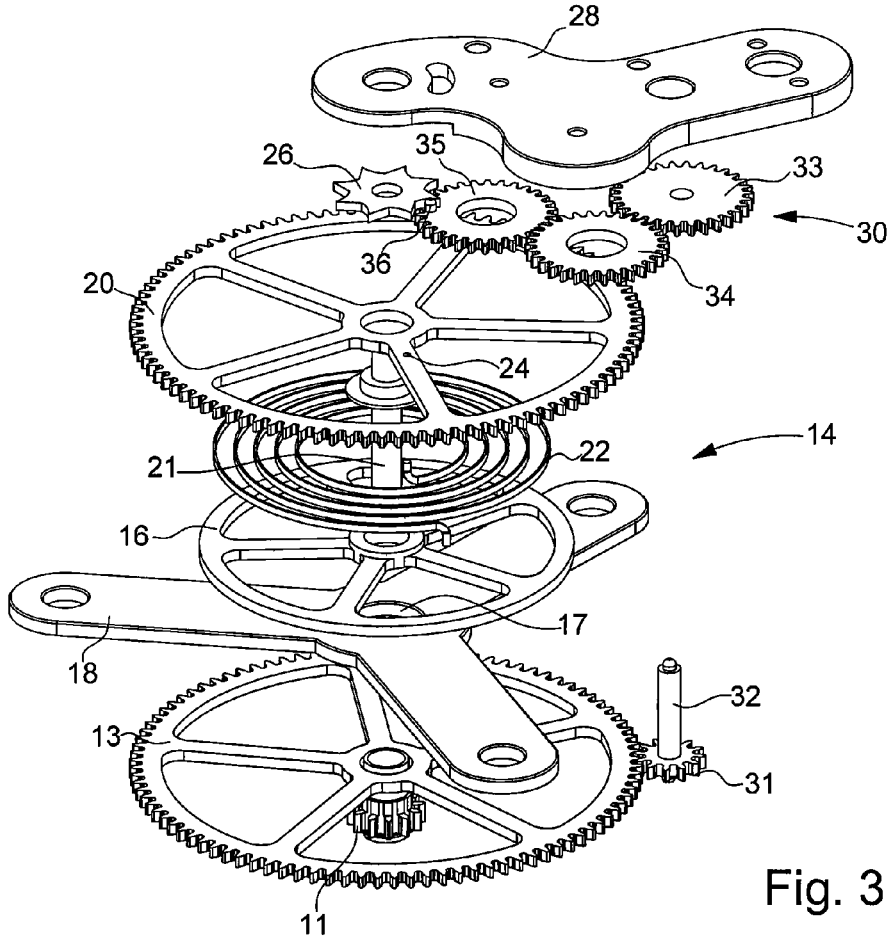
FIG. 3 is an exploded view of the constant force device.
Figure 4:
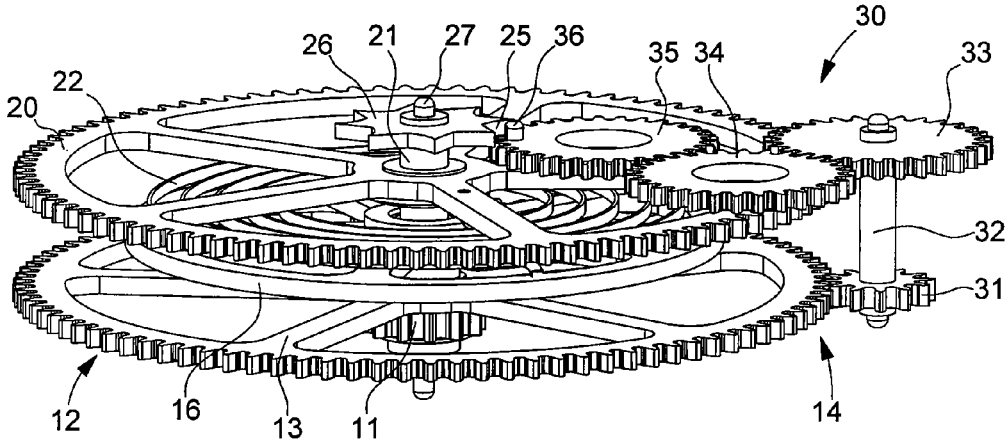
FIG. 4 is a perspective view of the constant force device, without the bridges that carry it.

Centre wheel 6 meshes on pinion 11 of a third wheel set 12 comprising a first third wheel 13. Wheel set 12 is associated with the constant force device 14 shown in detail in FIGS. 3 and 4. Wheel set 12, which has an axis of rotation 15, further comprises a plate 16 with a short tubular arbour (not visible in the drawings) that is mounted via a bearing 17 in a bridge 18 and driven into the central hole of wheel 13. Wheel set 12, driven by the motor torque provided by barrel 2, forms the input element of constant force device 14. A second third wheel 20, forming the output element of constant force device 14, is coaxial to the first third wheel 13, this wheel 20 being secured to an arbour 21 rotatably mounted at the centre of wheel set 12. A spiral spring 22 is placed between plate 16 and wheel 20, which connects one to the other in rotation in a resilient manner, the inner end of the spring being secured in a hole 24 of one branch of wheel 20, whereas the outer end of the spring is secured to plate 16.

A star wheel 16 with eight branches 25 is secured to the top end of star wheel 21, which further includes a pivot 27 carried by a bearing in a bridge 28. Star wheel 26 acts as a locking member for a stop train 30 driven by the first third wheel 13. In fact, the latter meshes on a pinion 31 of an arbour 32 rotatably mounted in bridges 18 and 28 and provided with a wheel 33 above the level of wheel 20. Stop train 30 ends in a stop wheel 35 driven by wheel 33 via the insertion of an intermediate wheel 34 in order to rotate in the opposite direction to the star wheel. Wheels 34 and 35 are carried by bridge 28. Wheel 35 is provided with an off-centre finger 36 which abuts successively against each branch of star wheel 26 during the rotation thereof, like the flirt of the devices of the prior art. While the star wheel is thus preventing wheel 35 and thus stop train 30 from rotation, rotation of the first third wheel 13 and all of the preceding train is stopped.

The second third wheel 20 meshes on a seconds pinion 38 which completes one revolution per minute and which, in the present example, is secured to the cage 41 of a tourbillon 40 containing, in a conventional manner, the escapement and the mechanical sprung balance oscillator, of which the balance 42 centred on the axis of rotation 44 of cage 41, can be seen. The cage can carry a seconds hand 45, as shown schematically in FIG. 1. The toothings of the seconds pinion 38 and the second third wheel 20 are dimensioned such that wheel 20 and star wheel 26 complete one revolution in eight minutes.

When constant force device 14 is assembled, the relative positions of plate 16 and wheel 20 are fixed by means of stop train 30 such that spiral spring 22 is pre-loaded with the desired torque for operating the regulator member of the watch movement in an optimal manner, in this case tourbillon 40. Spring 22 preferably has several turns, so that the torque that it transmits from wheel set 12 to wheel 20 does not vary substantially while wheel 20 completes an eighth of a revolution whilst plate 16 is stopped.

In operation, the elements of movement 1 rotate in the directions indicated by arrows in FIG. 1. On the downstream side of constant force device 14, the rotation rate is that of the escapement wheel contained in the tourbillon, for example six steps per second if the oscillation frequency of the balance 42 is 3 Hz. Upstream of the constant force device, the intermittent rotation rate is once step per minute, for the following reasons.

While branch 25 (see FIG. 4) of star wheel 26 is holding finger 36 of stop train 30, the third wheel set 12 remains locked and immobilises all of the train located upstream, including the display by hands 7 and 9. During this phase, the escapement loaded by spring 22 maintains the oscillation of balance 42 and lets the second third wheel 20 and its star wheel 26 rotate at the speed of one eighth of a revolution per minute. Via this rotation, finger 36 pressed against branch 25 of the star wheel, is eventually released, which enables stop wheel 35, driven from barrel 2, to rotate quickly until finger 36 is stopped by the next branch of star wheel 26. Via stop train 10 which has a reduction ratio of 1:8, this rotation allows third wheel set 12 to rotate quickly through one eighth of a revolution and thus catch up the second third wheel 20 while rewinding spring 22. The quasi-instantaneous rotation of third wheel set 12 allows a rotation of one sixtieth of a revolution of centre wheel 6, and thus also of the cannon-pinion and minute hand 7. All of these elements are then immobilised for one minute by star wheel 26.

The construction described hereinbefore and shown in the drawings is only one example from among other possible embodiments of the invention. In particular, the number of branches of star wheel 26 could be different to eight if the transmission ratio between the second third wheel 20 and the seconds pinion 38 were different. Moreover, the star wheel is not necessarily secured to wheel 20, to which it could be connected via a gearing in order to be placed next to the latter and to cooperate with a finger placed on wheel 33, for example. Another variant could comprise more than one finger 36 on stop wheel 35, which would only complete a fraction of a revolution each minute. It should also be mentioned that the invention can be applied without any difficulty to a movement of the type wherein the cannon-pinion is not carried by centre wheel 6, but by a wheel driven by the third pinion, as is common with a central seconds arbour.

What is claimed is:

1. A watch comprising:

(a) a movement that includes a constant force device inserted in a going train connecting a spring barrel to an escapement having an escapement wheel and including a third wheel that completes one revolution in several minutes and drives a seconds pinion completing one revolution per minute, the constant force device including i. an input element;

ii. an output element coaxial to the input element and mechanically connected to a star wheel with several branches;

iii. a spiral spring resiliently connecting the input element to the output element in rotation and a stop train meshed with a stop element and provided with a stop wheel having at least one finger arranged to abut against one branch of said star wheel, wherein said third wheel is an output third wheel that is the output element of said constant force device and the input element of the constant force device is formed by an input third wheel, and wherein said output third wheel meshes with said seconds pinion that meshes in turn with an escapement pinion; and (b) an independent minutes display with a minute hand driven by the going train, the number of branches of the star wheel being equal to the number of minutes during which the star wheel completes one revolution, such that the rotation of the star wheel releases the stop train and the input third wheel once per minute.

2. The watch according to claim 1, wherein the star wheel is secured to the output third wheel.

3. The watch according to claim 2, wherein the stop train includes an arbour parallel to the axis of rotation of the input third wheel and having a pinion meshed on the input third wheel said arbour being provided with a wheel connected by a gearing to the stop wheel via an intermediate wheel.

4. The watch according to claim 3, wherein the input third wheel is associated with a plate, to which one end of said spiral spring is secured, and said input third wheel is carried by means of a bridge located between said plate and the first input third wheel.

5. The watch according to claim 1, wherein the seconds pinion is secured to the cage of a tourbillon which contains the escapement.

6. The watch according to claim 1, wherein the star wheel is secured to the output third wheel.

7. A watch comprising:

(a) a movement including a constant force device inserted in a going train connecting a spring barrel to an escapement having an escapement wheel and including a third wheel that completes one revolution in several minutes and drives a seconds pinion completing one revolution per minute, the constant force device including i. an input element;

ii. an output element coaxial to the input element and mechanically connected to a star wheel with several branches; and iii. a spiral spring resiliently connecting the input element to the output element in rotation and a stop train meshed with a stop element and provided with a stop wheel having at least one finger arranged to abut against one branch of said star wheel, wherein said third wheel is an output third wheel and is the output element of said constant force device and the input element of the constant force device is formed by an input third wheel; and (b) an independent minutes display by a minute hand driven by the going train, the number of branches of the star wheel being equal to the number of minutes during which the star wheel completes one revolution, such that the rotation of the star wheel releases the stop train and the input third wheel once per minute.

8. The watch according to claim 7, wherein the star wheel is secured to the output third wheel.

* * * * *